US011779111B2

(12) United States Patent
Saenz

(10) Patent No.: US 11,779,111 B2
(45) Date of Patent: Oct. 10, 2023

(54) STUDENT SMART DESK AND IMPROMPTU SHIELDING SYSTEM

(71) Applicant: Genesis Kenneth Saenz, Corona, CA (US)

(72) Inventor: Genesis Kenneth Saenz, Corona, CA (US)

( * ) Notice: Subject to any disclaimer, the term of this patent is extended or adjusted under 35 U.S.C. 154(b) by 95 days.

(21) Appl. No.: 17/522,750

(22) Filed: Nov. 9, 2021

(65) Prior Publication Data

US 2022/0142362 A1 May 12, 2022

Related U.S. Application Data

(60) Provisional application No. 63/111,085, filed on Nov. 9, 2020.

(51) Int. Cl.

| | |
|---|---|
| ***A47B 85/06*** | (2006.01) |
| ***F41H 5/06*** | (2006.01) |
| ***A47B 87/00*** | (2006.01) |
| ***A47B 39/12*** | (2006.01) |
| ***E01F 13/02*** | (2006.01) |

(52) U.S. Cl.

CPC ..... *A47B 85/06* (2013.01); *A47B 39/12* (2013.01); *A47B 87/002* (2013.01); *E01F 13/022* (2013.01); *F41H 5/06* (2013.01)

(58) Field of Classification Search

CPC ..... A47B 85/06; A47B 39/12; A47B 87/002; E01F 3/022; F41H 5/06

USPC ..... 89/36.01

See application file for complete search history.

(56) References Cited

U.S. PATENT DOCUMENTS

| | | | | |
|---|---|---|---|---|
| 6,170,379 | B1 * | 1/2001 | Taylor | F41H 5/08 89/36.01 |
| 6,622,607 | B1 * | 9/2003 | Miller | F41H 5/06 2/2.5 |
| 9,615,658 | B1 * | 4/2017 | Nobles | F41H 5/013 |
| 9,926,679 | B1 * | 3/2018 | Vila | E01F 13/022 |
| 10,591,258 | B1 * | 3/2020 | Drummond | F41H 5/24 |
| 10,866,068 | B1 * | 12/2020 | Trubacek | A47B 13/06 |
| 11,229,284 | B1 * | 1/2022 | Trubacek | A47B 13/06 |
| 11,350,746 | B1 * | 6/2022 | Nobles | A47B 13/08 |
| 2015/0033990 | A1 * | 2/2015 | Yeager | A47B 41/02 108/15 |

(Continued)

FOREIGN PATENT DOCUMENTS

| | | | | |
|---|---|---|---|---|
| WO | WO-2012018986 A1 * | 2/2012 | ..... | F41H 5/06 |

*Primary Examiner* — Samir Abdosh

(74) *Attorney, Agent, or Firm* — L/O ALEXIS J. SAENZ

(57) ABSTRACT

A smart desk and barricade provide ad-hoc protection during emergencies and an augmented presentation environment. A first desk tabletop includes a connection positioned on an underside of the first desk tabletop, that is configured for detachable coupling to a desk frame. Removal of the tabletop from the desk frame provides a shield. An interlocking element is positioned on one or more edges of the first desk tabletop. The interlocking element is configured to temporarily connect to an edge of a second desk tabletop. A temporary attachment of the first desk tabletop to the second desk tabletop forms a barricade system. In some embodiments, a computing device is integrated into the desk tabletop. A smart room environment may network the desk with integrated computing device to other computing devices in the room.

8 Claims, 13 Drawing Sheets

(56) References Cited

U.S. PATENT DOCUMENTS

| | | | | |
|---|---|---|---|---|
| 2015/0153143 | A1* | 6/2015 | Hollenbach | F41H 5/24 89/36.01 |
| 2019/0293390 | A1* | 9/2019 | Ahrens | F41H 5/08 |
| 2019/0301838 | A1* | 10/2019 | Birdsell | A47B 13/08 |
| 2020/0041232 | A1* | 2/2020 | Feirrell | A47B 41/02 |
| 2022/0142362 | A1* | 5/2022 | Saenz | F41H 5/013 |
| 2022/0167739 | A1* | 6/2022 | Clark | A47B 41/02 |

* cited by examiner

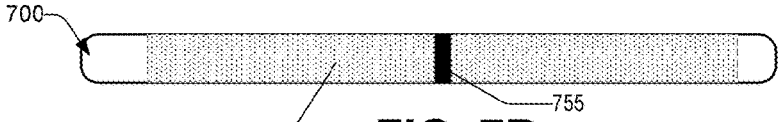
FIG. 7B
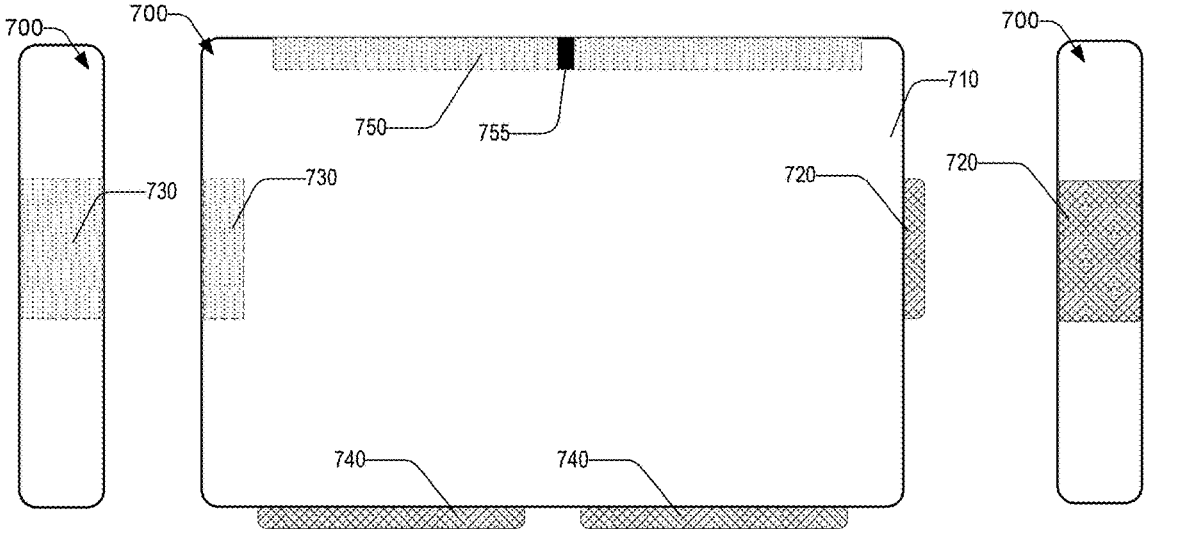
FIG. 7C
FIG. 7
FIG. 7D
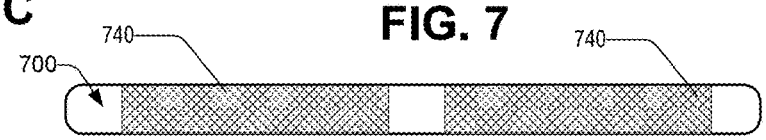
FIG. 7A

STUDENT SMART DESK AND IMPROMPTU SHIELDING SYSTEM

CROSS-REFERENCE TO RELATED APPLICATION

This application claims benefit under 35 U.S.C. § 119(e) of U.S. Provisional Application having Ser. No. 63/111,085 filed Nov. 9, 2020, which is hereby incorporated by reference herein in its entirety.

FIELD

The subject disclosure relates to furniture, and more particularly, to a student smart desk and impromptu shielding system.

BACKGROUND

An unfortunate part of the student learning process is the need to practice preparing for dangerous emergencies caused by other students. For example, there have been a number of incidents in recent years where students arrive to campus bearing firearms and open fire on fellow students, teachers, and other adults. The current approach to reacting to a school shooting is to quickly lock a door, turn off lights and hide in the dark hoping that the gunman does not enter the class. This unfortunately is stalling for time and hoping for random luck. Should the gunman enter the classroom, everyone inside is at their mercy.

In some instances, students will try and barricade themselves behind desks. Conventional desks are generally wooden (for example, pressed wood) and easily broken and pierceable by some higher caliber bullets. As may be obvious, student classroom desks today have changed very little for decades as they mainly try to offer affordable seating with a writing platform.

As can be seen, there is a need for improved desks for the student experience. In addition, there is a need to improve the security in the student environment.

SUMMARY

In one aspect of the disclosure, a barricade apparatus is disclosed. The apparatus includes a first desk tabletop. A connection is positioned on an underside of the first desk tabletop. The connection is configured for detachable coupling to a desk frame. An interlocking element is positioned on one or more edges of the first desk tabletop. The interlocking element is configured to temporarily connect to an edge of a second desk tabletop. A temporary attachment of the first desk tabletop to the second desk tabletop forms a barricade.

In another aspect of the subject technology, a barricade system is disclosed. The barricade system includes a first desk including a first tabletop and a first desk frame. The first tabletop is detachable from the first desk frame. A second desk includes a second tabletop and a second desk frame. The second tabletop is detachable from the second desk frame. A first interlocking element is included on a first edge of the first tabletop. A second interlocking element is included on a first edge of the second tabletop. The first interlocking element is configured to connect to the second interlocking element, in the event the first tabletop and the second tabletop are detached from the first desk frame and from the second desk frame to form a barricade or part of a barricade wall using the first tabletop and the second tabletop as barricade sections.

It should be understood that the above described aspects may in some embodiments be distinct from one another or combine elements from one or the other aspect(s) in some embodiments. However, the claims should not be read to require any particular feature from one aspect to another aspect in the subject disclosure.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

FIG. 7 is a top view of a detachable desk tabletop according to some embodiments of the present disclosure.

FIG. 7A is a front edge view of the desk tabletop of FIG. 7.

FIG. 7B is a rear edge view of the desk tabletop of FIG. 7.

FIG. 7C is a left edge view of the desk tabletop of FIG. 7.

FIG. 7D is a right edge view of the desk tabletop of FIG. 7.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

In general, illustrative embodiments of the subject technology provide a desk for protection and/or augmented presentation of information. In one aspect, the desk may include a quick disconnect feature so that the desk tabletop is detachable from the frame so the tabletop may provide a personal shield. In another aspect, the desk may be interlocked with adjacent desks to form an impromptu barricade to protect a group of students behind the barricade from, for example, a prospective attacker. In one sense the shield/barricade aspect of the apparatus may be temporary for ad-hoc emergency situations including for example, a shooter on premises, falling debris from an earthquake, or the impact of objects from an explosion.

In another aspect, the desk may include smart features to improve presentation and information access/dissemination. In an illustrative application, the smart desk embodiments may improve the daily learning experience of students by incorporating a computing function integrated into the desk platform. The computing functions may be capable of being networked to create a smart presentation environment. A master computing device may communicate information to slave desk computing devices and receive communication from the desk computing devices. Some embodiments may include a smart board in communication with the master computing device and the smart desks.

Figure 1:
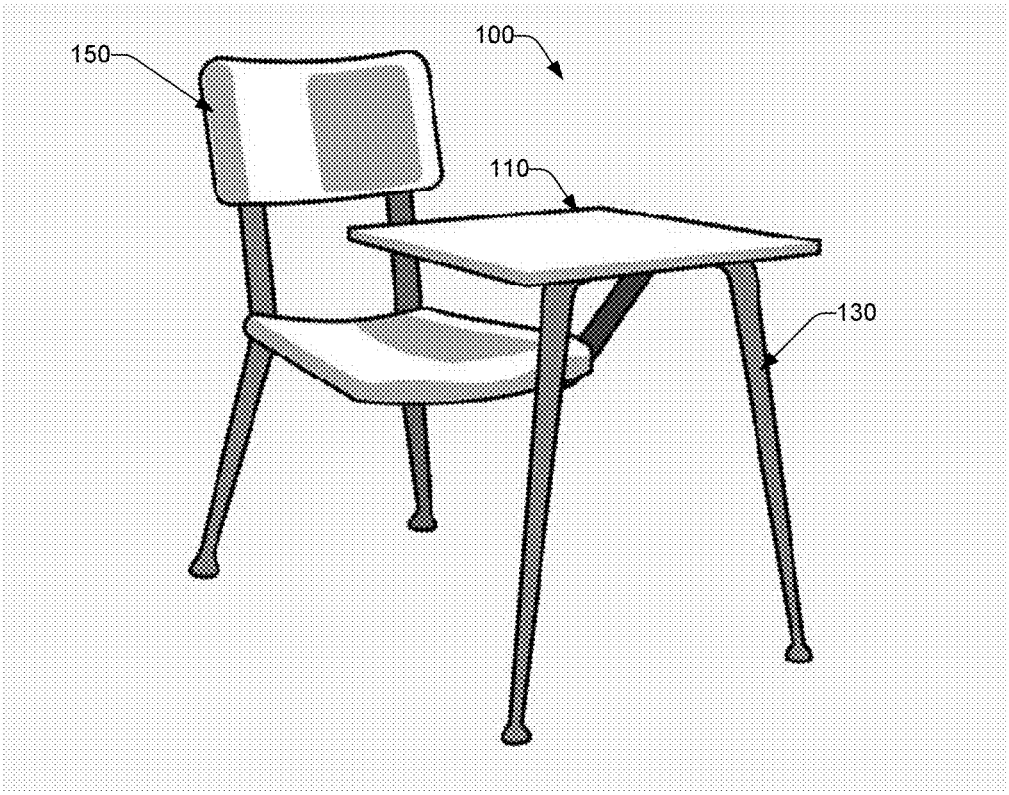
FIG. 1 is a perspective front view of a desk according to an embodiment of the subject technology.
Figure 2A:
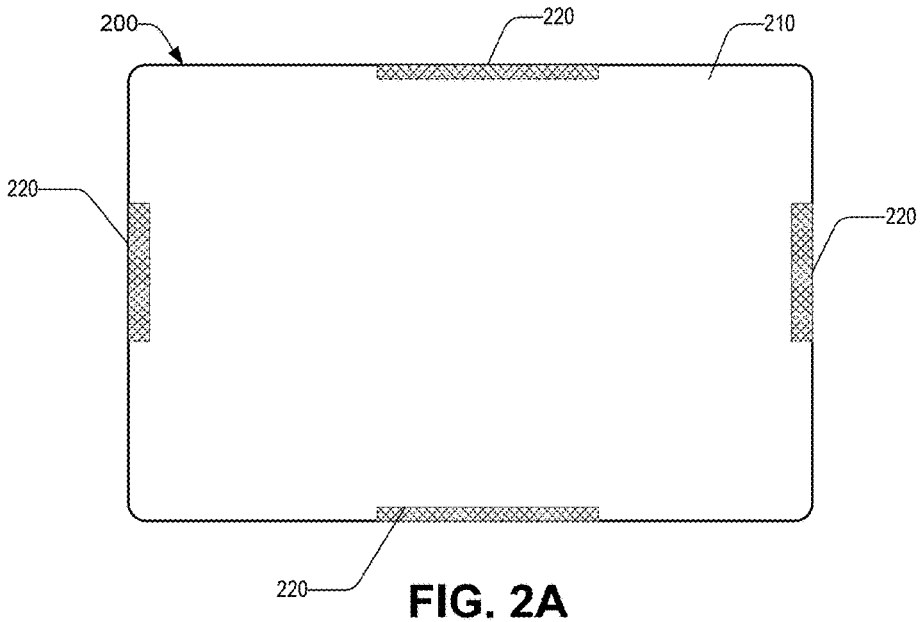
FIG. 2A is a top view of a detachable desk tabletop according to some embodiments of the present disclosure.
Figure 2C:
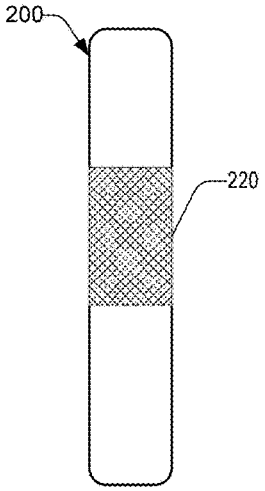
FIG. 2C is a right edge view of the desk tabletop of FIG. 2A.
Figure 2B:
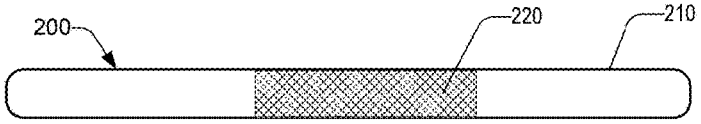
FIG. 2B is a front edge view of the desk tabletop of FIG. 2A.

Referring now to the Figures, FIG. 1 shows a desk 100 according to an illustrative embodiment. The desk 100 may be for example, a classroom school desk. It should be understood however, that the school desk embodiment is illustrative only and other desks are contemplated within the scope of the present disclosure. The desk 100 may include a detachable desk tabletop 110 removably (or separably) connected to a desk frame 130. Some embodiments include a quick disconnect feature so that the desk tabletop 110 is quickly removed from the desk frame 130. Some embodiments of the desk 100 may include a chair 150 integrated to the desk frame 130, however other embodiments may exclude the chair 150 as not necessarily being part of the desk 100.

The below disclosure includes descriptions of desk tabletops according to various embodiments. When reviewing the description of the desk tabletops, for sake of reference points, the tabletops should be considered as oriented from the perspective of a person sitting behind the edge closest to the bottom of the figure. Accordingly, in top views of the tabletop, the bottom edge will be referenced as the "front" edge, the top edge as the "rear" edge, and the lateral edges will be "right" and "left" relative to the bottom edge.

FIGS. 2A-2C and 3 show a desk tabletop 200 according to an illustrative embodiment. The desk tabletop 200 includes a top surface 210 and multiple edges. In a rectangular embodiment, the edges include front, rear, left, and right edges. The desk tabletop 200 includes one or more interlocking elements 220. The interlocking element(s) 220 may be on one or more of the front, rear, left, and right edges. Generally speaking, the desk tabletop 200 includes an interlocking element 220 on an edge of the tabletop that will be placed into juxtaposition with an edge of another desk tabletop 200 so that the interlocking elements 220 of respective tabletops 200 connect together. In some embodiments, the interlocking element 220 may be magnetic. The interlocking element 220 may be integrated into the body of the desk tabletop 200 or may wrap around the edge of the tabletop (extending from the top surface 210 around the edge to the bottom surface 230). In some embodiments, the interlocking element 220 on one tabletop 200 may be magnetic and the corresponding interlocking element 220 on the other tabletop 200 may be metallic. In some embodiments, the desk tabletop 200 includes a quick release fastener 240 that is positioned to reliably attach to the desk frame.

In some embodiments, the desk tabletop 200 may comprise a bullet resistant or bullet-proof material such as plexiglass or polycarbonate. The desk tabletop 200 may be transparent or opaque. A transparent shield or barricade may be desirable so that user may move and react based on seeing the actions of the attacker on the other side of the system.

Figure 3:
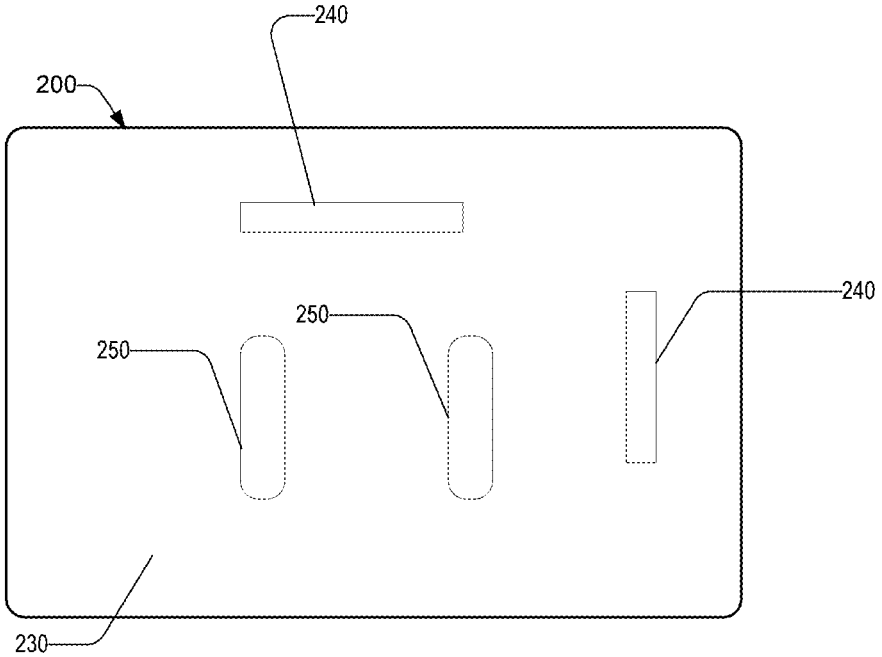
FIG. 3 is a bottom view of the desk tabletop of FIG. 2A.

In FIG. 3, two quick release fasteners 240 are shown in positions that correspond to lateral and vertical frame bars that one may seen in some student desks (see for example FIG. 1 and desk frame 130). The quick release fastener 240 may be for example an elongated, snap fit clip, a clamp, or similar fastener. Some embodiments of the desk tabletop 200 include one or more handles 250 that are grasped to manipulate the desk tabletop 200 into position as a shield and/or for connecting to adjoining desk tabletops 200. The handles 250 may be firm or flexible. The user may crouch behind or under the desk tabletop 200 as needed when used as a personal shield.

Figure 4:
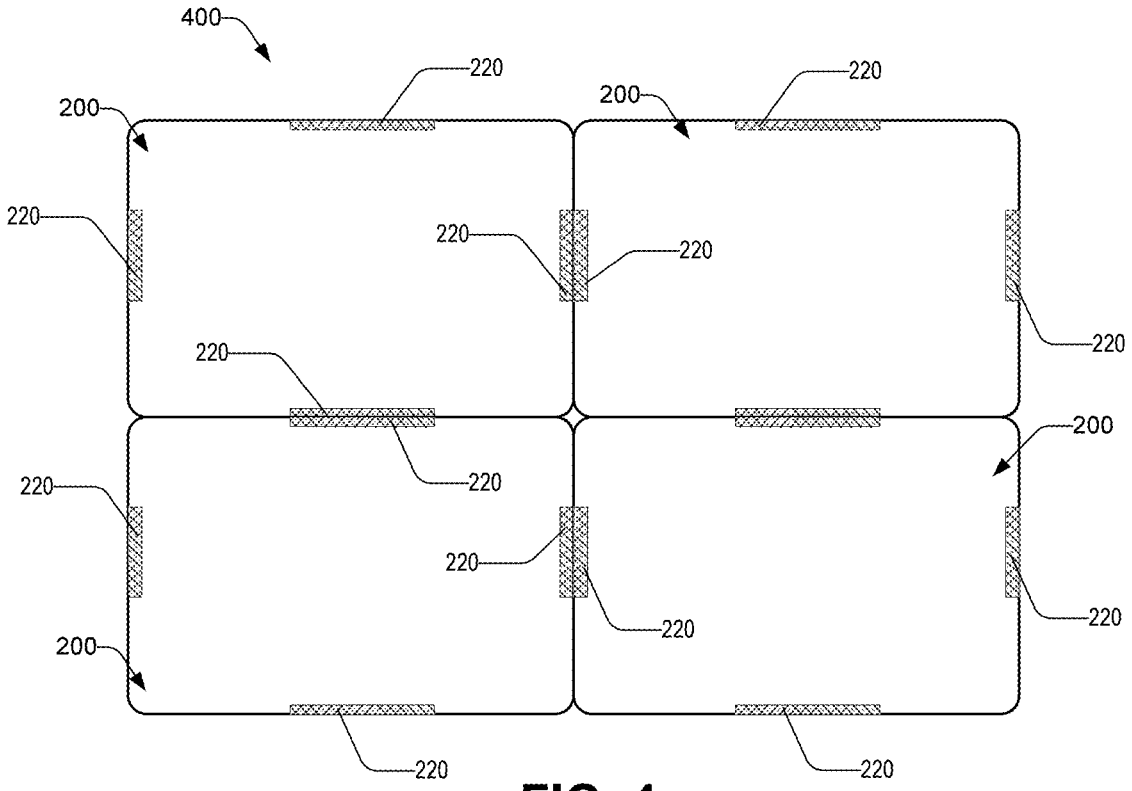
FIG. 4 is a front view of a barricade system comprising multiple detachable desk tabletops connected together according to an embodiment.
Figure 5B:
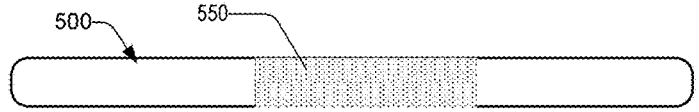
FIG. 5B is a rear edge view of the desk tabletop of FIG. 5.
Figure 5C:
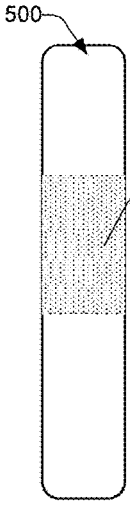
FIG. 5C is a left edge view of the desk tabletop of FIG. 5.
Figure 5:
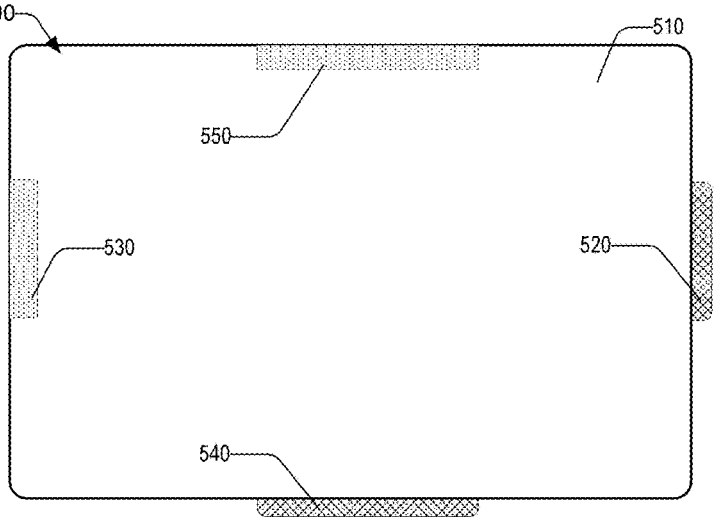
FIG. 5 is a top view of a detachable desk tabletop according to some embodiments of the present disclosure.
Figure 5D:
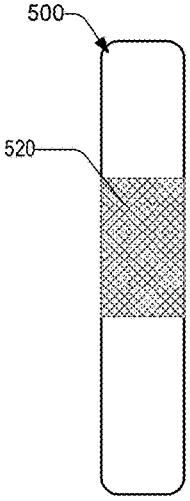
FIG. 5D is a right edge view of the desk tabletop of FIG. 5.
Figure 5A:
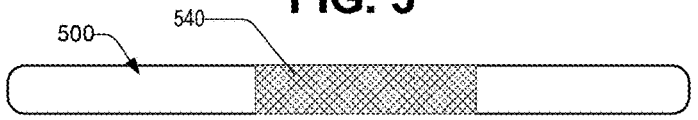
FIG. 5A is a front edge view of the desk tabletop of FIG. 5.

FIG. 4 shows a barricade system 400 that may be created by connecting a plurality of desk tabletops 200 together. Embodiments of the desk tabletop 200 may include the interlocking elements 200 on all edges so that the barricade system 400 may extend in multiple directions by connecting desk tabletops 200 along different edges with other desk tabletops 200. While a generally rectangular barricade system 400 is shown, it will be readily appreciated that that shape and configuration of dimensions for the barricade system 400 may be constructed with many variations depending on the situation and number of people helping construct the barricade wall. While the intersection between adjoining corners of desk tabletops 200 show an opening, it will be appreciated that the magnitude of curvature at the corners may be adjusted to make the size of the opening negligible.

In operation, in the event of a potential shooter emergency or other dangerous event that may necessitate shielding, a student (or another person) would quickly detach the desk tabletop 200 from its supporting frame. The user may cooperate with other users to couple adjacent desk tabletops 200 together forming a shield wall (barricade 400).

Referring now to FIGS. 5, 5A-5D, and 6, a desk tabletop 500 is shown according to another embodiment. The desk tabletop 500 may be similar in construction to the desk tabletop 200 except that interlocking elements 520 and 530 may comprise a tongue and groove (or slot) system on opposing lateral edges of desk tabletops so that the tongue 520 or tab of one desk tabletop locks into the groove 530 or slot/channel of an adjacent desk's tabletop 500. Some embodiments may include a tongue 540 on the front edge and a groove 550 one the rear edge so that rows of the tabletops are stacked vertically to extend the height of the wall in addition to the width of the wall. The handles on the underside may face rearward toward the users so that the students and adults may support or brace the barricade. It should be understood that the grooves 530 and 550 are shown in shadow lines so that one can see the compartment within the desk tabletop body that the tongue 520 or 540 locks into. In some embodiments, the grooves 530; 550 are configured for press fit or snap-in receipt of respective tongues 520;540. While the term "tongue" has been used, the interlocking element(s) 520 or 540 may be any projection, flange, protuberance, tab, or the like. In some embodiments, the tongue(s) 520; 540 may be magnetic. The grooves 530; 550 may be magnetic. In some embodiments, the interlocking elements 520; 530; 540; and 550 are not magnetic and rely on mechanical structure to couple and maintain the connection.

Figure 6:
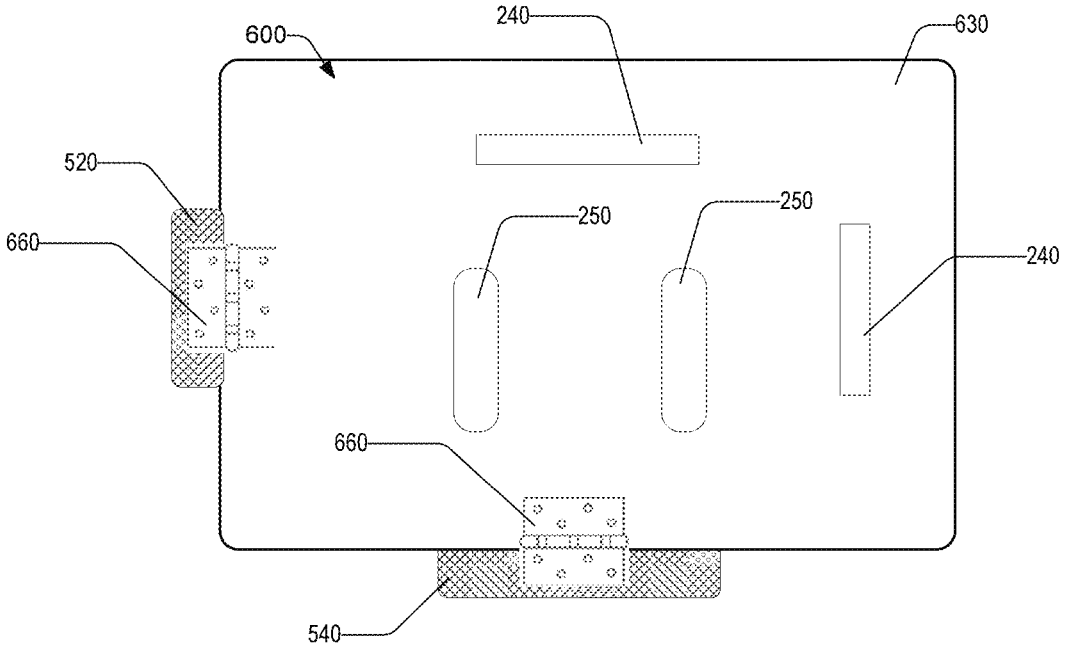
FIG. 6 is a bottom view of the desk tabletop of FIG. 5 according to some embodiments.

FIG. 6 shows a bottom view of a desk tabletop 600 which is similar to the desk tabletop 500 except that the grooves 530 and 550 are omitted for sake of illustration. In some embodiments, the interlocking elements 620 and 640 (for example tongues) may be configured to provide at least some rotation at the joint with the cooperating interlocking element (for example, groove or the like). In one embodiment, the desk tabletop 600 includes a hinge 660 coupled to interlocking elements 620 and 640. In one aspect, the hinge 660 may be used to fold the interlocking elements 620 and 640 inward under the bottom surface 630 so that the interlocking elements 620 and 640 do not project outward during daily use (which may catch articles of clothing, backpacks, or body parts as one passes by the desk edges). In another aspect, embodiments of the desk tabletop that incorporate a hinge 660 provide some flexibility in the resulting barricade. For example, the top of the barricade may be tilted back and down from the plane of the rest of the wall when interlocking means are included on the front and rear edges of the tabletop 600. (See for example, FIG. 4 for a barricade system which may be modified to include hinges and/or projecting interlocking elements). This may prevent for example, a direct line of sight for a shooter pointing a firearm over the barricade since the users may stay out of the line of sight behind the angled top of the barricade. In some scenarios, providing overhead protection may be desirable when debris or falling objects from above is known to be impending. In some embodiments, the lateral edge joints may pivot so that the tabletops 600 may rotate inward around hinges. This may be helpful in scenarios where the barricade systems of the present disclosure are used in cooperation with the intersection of walls in the classroom to prevent entry of the assailant from the sides of the barricade. The inclusion of the hinge 660 may provide a dome arrangement in some configuration when the tabletops are configured to rotate along both the vertical and horizontal planes protecting users inside from all sides.

Figure 8:
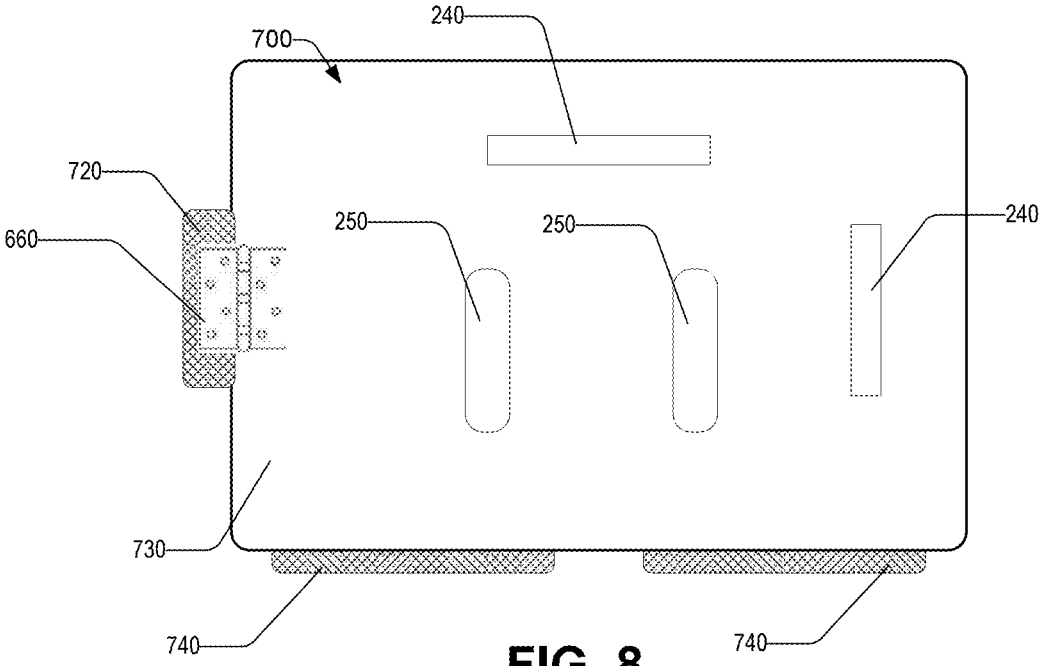
FIG. 8 is a bottom view of the desk tabletop of FIG. 7 according to some embodiments.
Figure 9:
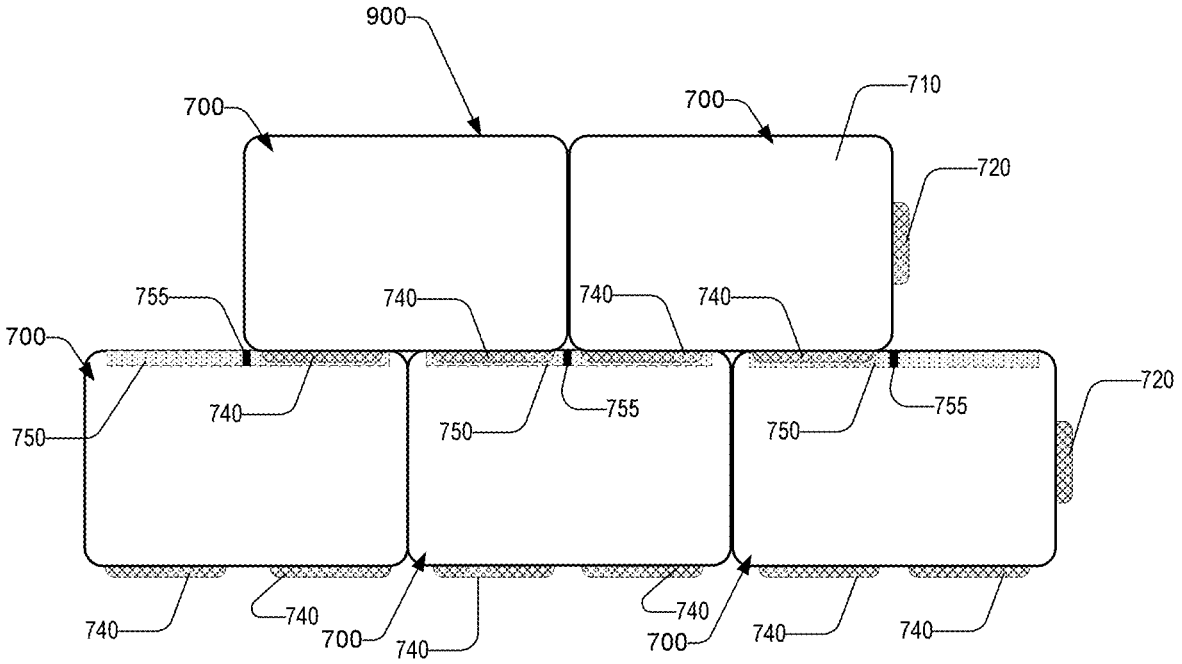
FIG. 9 is a front view of a desk tabletop barricade system comprising a plurality of the desk tabletops of FIG. 7 according to some embodiments of the present disclosure.

Referring now to FIGS. 7, 7A-7D, 8, and 9, a desk tabletop 700 is shown according to an illustrative embodiment. The desk tabletop 700 is similar to desk tabletops 500 and 600 (for example, the top surface is designated as element 710, the bottom surface 730 similar to the numbering in previous embodiments, and the quick release fasteners 240 and handles 250 may be present), except that the interlocking elements 740 and 750 are configured for staggered connection and arrangement with adjoining desk tabletops 700. FIG. 9 shows a barricade system 900 of staggered, connected desk tabletops 700 according to an embodiment. As will be appreciated, the features of the desk tabletop 700 provide adjoining desk tabletops to be offset when connected, which may provide a stronger, reinforced barricade structure. In addition, the opening at the intersections of desk top corners may become smaller.

The interlocking element 750 may comprise a groove that may include a baffle(s) 755 (or other separator) that defines two (or more) distinct compartment slots. The interlocking elements 740 may comprise a plurality of tongues that are positioned to slide into respectively aligned compartment slots of an adjoining desk tabletop's interlocking element 750, with the baffle 755 separating the adjacent tongues 740. As will be appreciated, embodiments of the connection of adjoining desk tabletops 700 allow for a one-to-one connection (similar to the arrangement in FIG. 4). The embodiment shown in FIG. 7 also allows for the staggered arrangement shown in FIG. 9 by setting one tongue of 740 of a first desk tabletop into the compartment slot of a second desk tabletop's interlocking element 750 and the second tongue 740 of the first desk tabletop into the compartment slot of a third desk tabletop's interlocking element 750. The interlocking element 750 is shown in shadow lines to represent the interior of the element so one can see the position of the tongues 740 into respective interior compartments and the baffle 755 between tongues 740.

The laterally positioned interlocking elements 720 and 730 are similar to interlocking elements 520 and 530. However, it should be understood that in some embodiments, the laterally (side edge) disposed interlocking elements 720 and 730 may be modified for staggered connection similar to the front and rear edge interlocking elements 740 and 750. In addition, some embodiments of the desk tabletop 700 may include the hinge 660 on any of the interlocking tongue type elements (720 or 740) even though FIG. 8 shows the hinge 660 on just the interlocking element 720.

Figures 10, 10A:
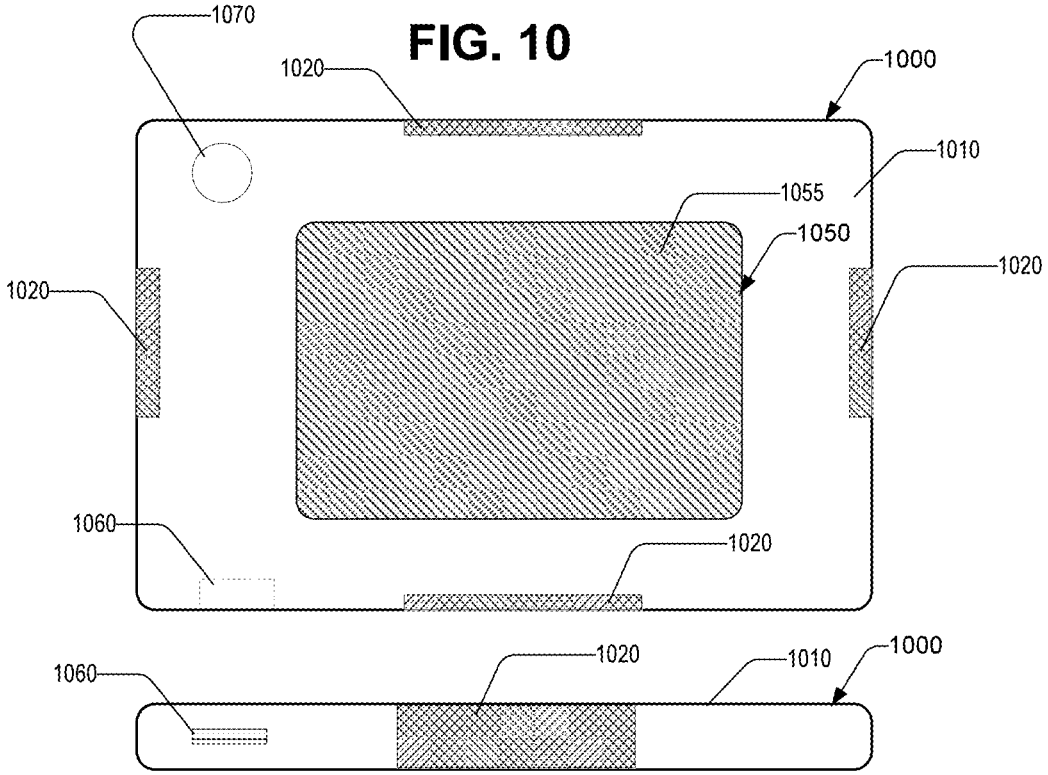
FIG. 10 is a top view of a detachable smart desk tabletop according to some embodiments of the present disclosure.
FIG. 10A is a front edge view of the detachable smart desk tabletop of FIG. 10.

Referring now to FIGS. 10, 10A, 11A, 11B, 12, and 13, embodiments related to a smart desk and system are shown. In FIGS. 10 and 10A, a smart desk tabletop 1000 is shown. The smart desk tabletop 1000 may be detachable from a desk frame and may be coupled to adjoining desktops similar to the embodiments described above in FIGS. 1, 2A-2C, 3-5, 5A-5D, 6, 7A-7D, 8 and 9. For example, interlocking elements 1020 are shown but any of the previously disclosed interlocking element embodiments may be included. Likewise, the rear surface of the desk tabletop 1000 is not shown since the rear may share features of the previously described embodiments.

In an exemplary embodiment, smart desk tabletop 1000 includes a computing system 1050 integrated into the body of the desk tabletop 1000. A display area 1055 of the tabletop 1000 may be configured for tactile or capacitive input. Some embodiments of the smart desk tabletop 1000 include a data/drive port 1060 which may be configured to receive data from a data storage device or connect to another computing device. The data/drive port 1060 may be for example, a universal serial bus (USB) port or other data port using a different communication protocol. Students may upload and download files to and from the desk computing system 1050 through the data/drive port 1060. In some embodiments, the smart desk tabletop 1000 may include a camera 1070. It will be understood that in embodiments using magnetic elements, shielding may be incorporated to protect elements sensitive to magnetic effects.

In some embodiments, the smart desk tabletop 1000 may include layers that protect the computing system 1050 behind bullet-proof or bullet-resistant material. The computing layer may be sandwiched between layers of the bullet resistant material. In an exemplary embodiment, a thinner layer of bullet resistant material may be positioned above the computing display section 1055. The thickness of the top layer may be configured thin enough to register user input without removing the protective aspect altogether. In an exemplary embodiment, a layer(s) at the bottom of the tabletop 1000 may be thicker to provide the safety from projectiles described earlier. Some embodiments may include a recess in the desk tabletop structure for insertion of the computing device. The computing device may be sealed behind the bullet-proof or bullet-resistant material (which material may also be present behind the computing device). Other layers of the smart desk tabletop 1000 may include opacity control which may include controlling by the CPU 1210 the transmissivity of light through the desk tabletop body to control transparency and opaqueness levels.

Figure 11A:
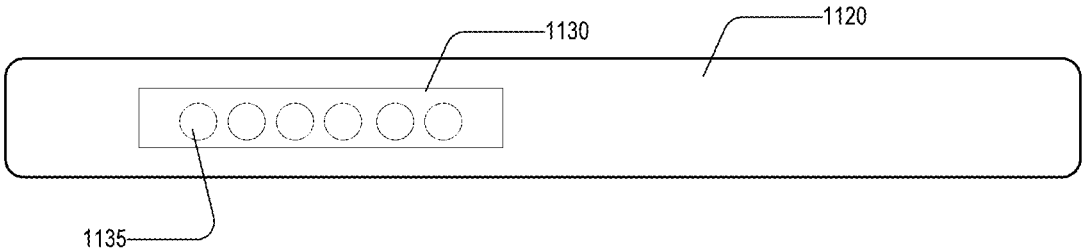
FIG. 11A is a front view of a female interlocking element including I/O communication ports for communication between connected desk tabletops according to embodiments of the present disclosure.
Figure 11B:
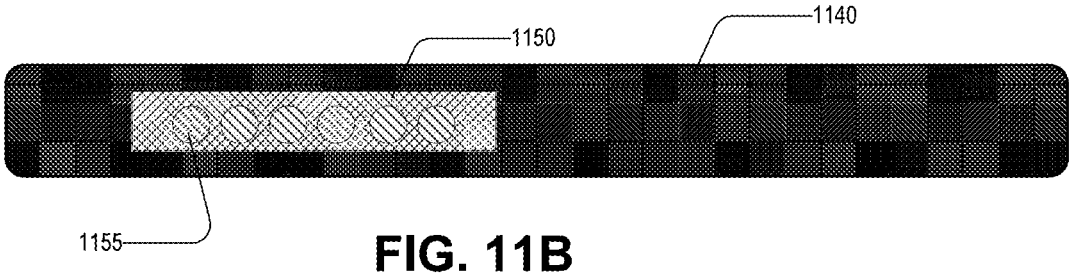
FIG. 11B is a front view of a male interlocking element including I/O communication ports for communication between connected desk tabletops according to embodiments of the present disclosure

Referring to FIGS. 11A and 11B, some embodiments may incorporate communication through interlocking elements 1120 and 1140. The interlocking elements 1120 and 1140 are shown in profile without the remaining elements of the smart desktop 1000 for sake of illustration and avoiding unnecessary repetition. FIG. 11A shows a female structure that includes a mating connector 1130 with pin ports 1135. The mating connector 1130 may be positioned in an open area (for example, groove or slot) of interlocking element 1120. FIG. 11B shows a male interlocking element 1140 (for example, a tongue or tab, etc.) configured to plug into the female interlocking element 1120. The male interlocking element 1140 includes a male connector 1150 that includes pins 1155 aligned to plug into the pin ports 1135. The connection of the interlocking elements 1120 to the interlocking elements 1140 provides an input/output (I/O) port 1250 for hardwired network communication between connected desk tabletops 1000.

Figure 12:
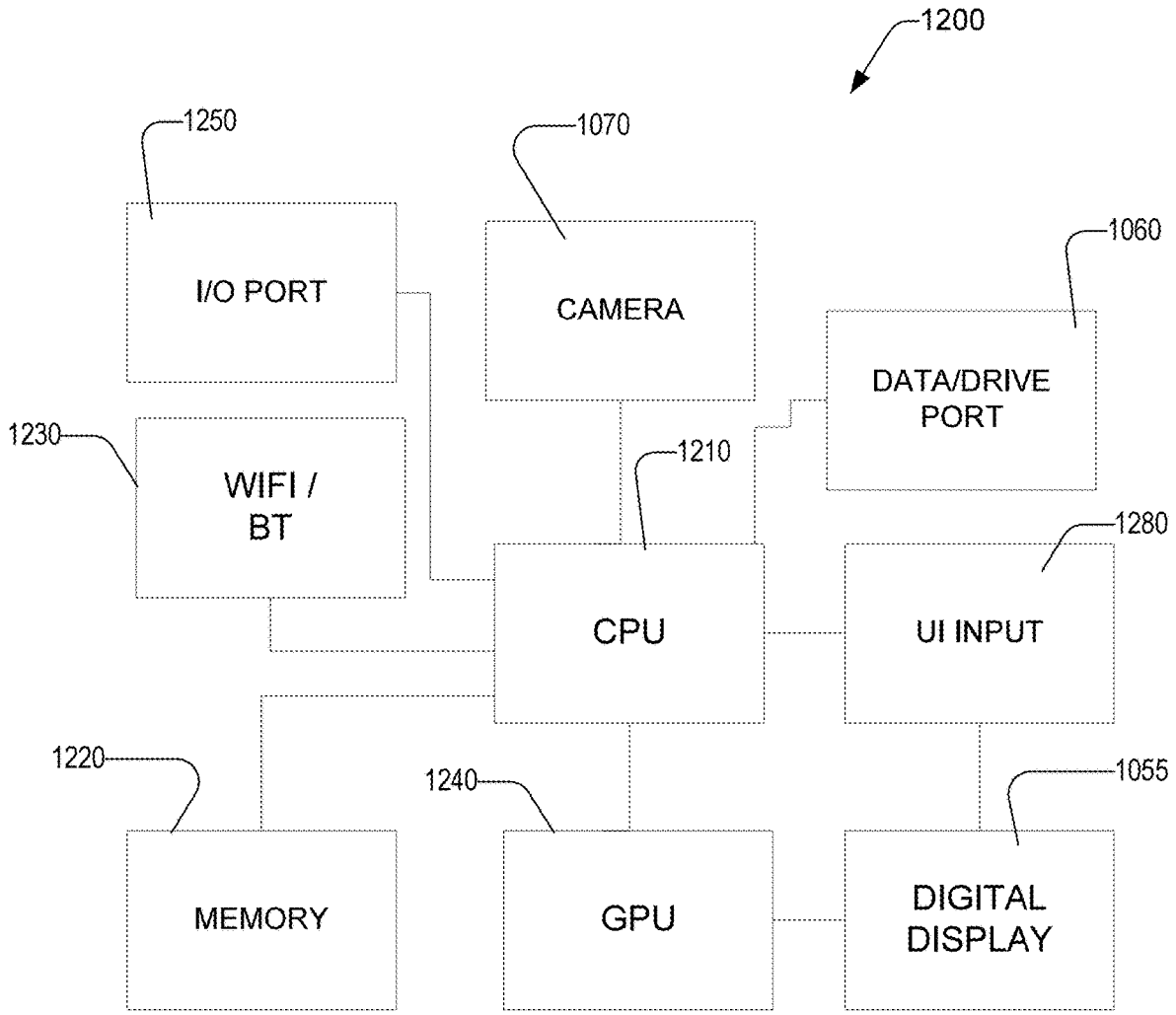
FIG. 12 is a block diagram of electronic and computing elements in a smart desk tabletop according to embodiments of the present disclosure.

Referring to FIG. 12, a block diagram shows an architecture 1200 of the smart desk tabletop 1000 according to some embodiments. The architecture includes elements not readily visible in the drawings and may be obstructed from view by other elements including for example, the display area 1055. Some of the electronic and computing elements that may comprise a smart desk according to exemplary embodiments include for example, a central processing unit (CPU) 1210, system memory 1220, a wireless telecommunications unit (for example, a Wi-Fi antenna and/or a short range module (using for example, Bluetooth® protocol) 1230, a graphics processing unit (GPU) 1240, and user interface input module 1280 (along with the previously disclosed digital display system 1055, data/drive port 1060, camera 1070, and I/O port 1250). The UI input module 1280 may comprise for example, a tactile response module or electronic pen recognition system. The data/drive port 1060 may receive personal memory drives (USB, flash, memory cards, etc.). A power source is omitted from view but will be understood as being present. The power source may be removable for charging in a separate charging device. In other embodiments, the computing system 1050 and power source may be a removable module package which may be removed from the desk tabletop 1000 body and charged and/or moved between desk tabletops 1000. In some embodiments where the computing system is modular, the digital display 1055 may remain separate from the module and integrated into the desk tabletop 1000. Yet in some other embodiments, the desk tabletop 1000 may include a recess or socket into which an external mobile computing tablet may be inserted for connection to the smart learning environment.

Figure 13:
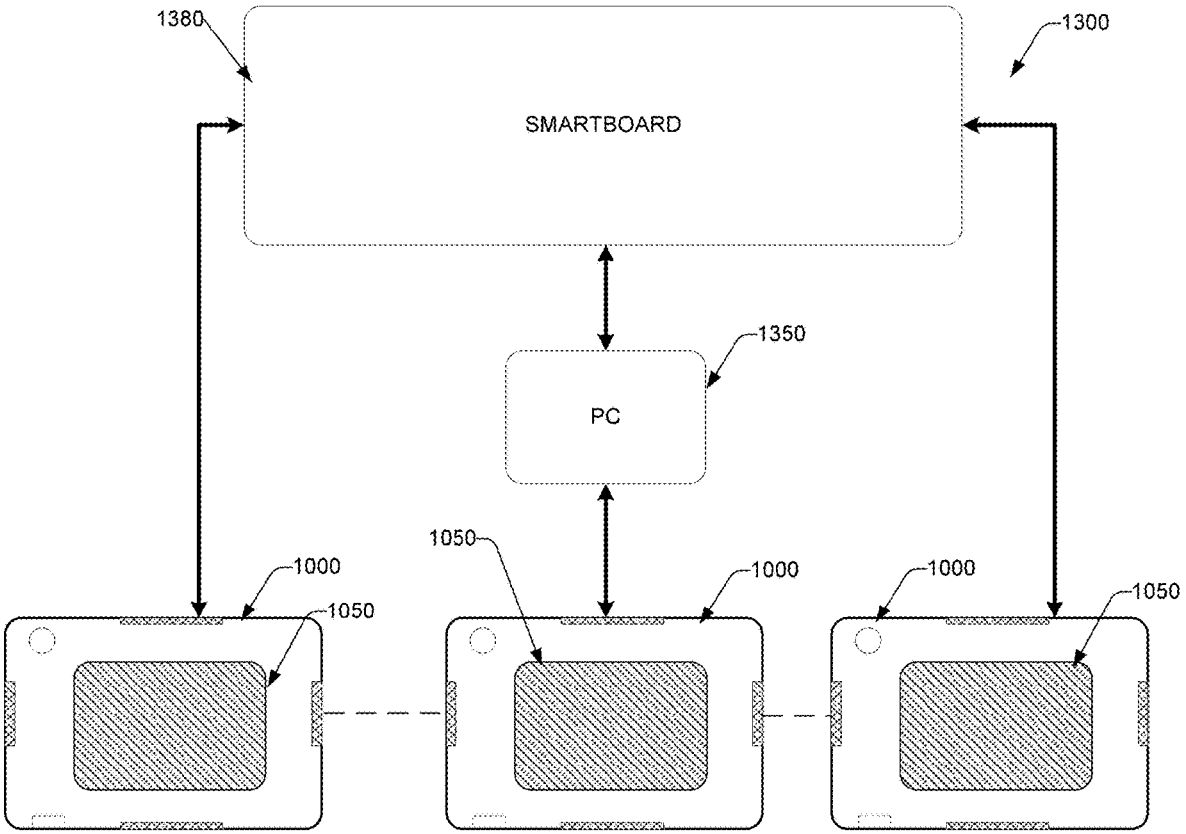
FIG. 13 is a block diagram of a system networking smart desks to a presentation environment according to embodiments of the present disclosure.

Some embodiments may be configured to provide a smart learning (or presentation) environment. FIG. 13 shows a system 1300 embodiment that includes multiple smart desk tabletops 1000 connected to a master computing device 1350 and/or to a smart whiteboard 1380. In an illustrative application, the display area 1055 may be configured to mirror subject matter the teacher is generating from the smart whiteboard 1380 so that users may see the material close up. In addition, students may interact with the display area 1055 through the use of sensory/input devices (for example, styluses) and virtual keyboards. Classwork may be performed and submitted directly from each desk unit to the master computing device 1350 administered by the teacher.

The embodiments in FIGS. 10, 10A, 11A, 11B, and 12-13 provide an improved system for sharing information. It should also be appreciated that the smart features also contribute to the safety and wellness of users in some situations. Interlocked computing desks may allow for students to work in group projects by communicating information through connected I/O ports 1250 (or wirelessly). In another aspect, when desk tabletops 1000 are connected and the respective desks' computing systems talk to one another, in an emergency scenario, the computing systems 101050 may provide additional features for the situation. For example, some desks tabletops 100 may include cameras 1070 that can capture video of the situation which may be transmitted wirelessly to third parties such as school administration and emergency responders. The connected computing systems may control transparency of the tabletops to selectively make some sections of the barricade opaque while leaving one or more sections transparent to provide visibility of the situation on the other side of the barricade. In some embodiments, the user interface display area 1055 may be flippable so that the UI input may be accessible from the underside of the desktop which may be facing rearward in some embodiments. This may allow users to continue to operate one or more computing systems 1050 during an emergency scenario.

Those of skill in the art would appreciate that various components and blocks may be arranged differently (e.g., arranged in a different order, or partitioned in a different way) all without departing from the scope of the subject technology.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A barricade system, comprising:

a first desk including a first tabletop and a first desk frame, wherein the first tabletop is detachable from the first desk frame;

a second desk including a second tabletop and a second desk frame, wherein the second tabletop is detachable from the second desk frame;

a first interlocking element on a first edge of the first tabletop;

a second interlocking element on a first edge of the second tabletop, wherein the first interlocking element is configured to connect to the second interlocking element, in the event the first tabletop and the second tabletop are detached from the first desk frame and from the second desk frame to form a barricade or part of a barricade wall using the first tabletop and the second tabletop as barricade sections.

2. The system of claim 1, wherein the first tabletop and the second tabletop comprise bullet resistant or bullet-proof material.

3. The system of claim 1, further comprising a handle on an underside surface of at least one of the first tabletop and the second tabletop.

4. The system of claim 1, further comprising a third interlocking element on a second edge of the first tabletop, wherein the third interlocking element is configured to connect to a fourth interlocking element positioned on a first edge of a third tabletop of a third desk.

5. The system of claim 4, wherein the second edge of the first tabletop is staggered from the first edge of the third tabletop in the event the first tabletop is connected to the third tabletop.

6. The system of claim 1, wherein at least one of the first interlocking element and the second interlocking element is a magnet.

7. The system of claim 1, wherein the first interlocking element is a tongue and the second interlocking element is a groove.

8. The system of claim 1, further comprising a hinge coupled to the first interlocking element, wherein the hinge is configured to swivel within the second interlocking element.

* * * * *